US011454367B2

(12) United States Patent
Lim et al.

(10) Patent No.: US 11,454,367 B2
(45) Date of Patent: Sep. 27, 2022

(54) SLIM TYPE LAMP APPARATUS FOR VEHICLE

(71) Applicants: Hyundai Motor Company, Seoul (KR); Kia Corporation, Seoul (KR); SL Corporation, Daegu (KR)

(72) Inventors: Jung Wook Lim, Seoul (KR); Byoung Suk Ahn, Gwacheon-si (KR); Sung Ho Park, Seoul (KR); Ki Hong Lee, Seoul (KR); Seung Sik Han, Hwaseong-si (KR); Jin Young Jung, Gyeongsan-si (KR); Hye Jin Han, Gyeongsan-si (KR)

(73) Assignees: HYUNDAI MOTOR COMPANY, Seoul (KR); KIA CORPORATION, Seoul (KR); SL CORPORATION, Daegu (KR)

( * ) Notice: Subject to any disclaimer, the term of this patent is extended or adjusted under 35 U.S.C. 154(b) by 0 days.

(21) Appl. No.: 17/412,752

(22) Filed: Aug. 26, 2021

(65) Prior Publication Data

US 2022/0186902 A1 Jun. 16, 2022

(30) Foreign Application Priority Data

Dec. 10, 2020 (KR) ..... 10-2020-0172448

(51) Int. Cl.

| | |
|---|---|
| ***F21S 41/36*** | (2018.01) |
| ***F21S 41/20*** | (2018.01) |
| ***F21S 41/143*** | (2018.01) |
| ***F21S 41/365*** | (2018.01) |
| ***F21W 102/20*** | (2018.01) |

(52) U.S. Cl.
CPC ..... *F21S 41/36* (2018.01); *F21S 41/143* (2018.01); *F21S 41/285* (2018.01); *F21S 41/365* (2018.01); *F21W 2102/20* (2018.01)

(58) Field of Classification Search
CPC ..... F21S 41/24; F21S 41/365
See application file for complete search history.

(56) References Cited

U.S. PATENT DOCUMENTS

| | | | | |
|---|---|---|---|---|
| 7,207,705 | B2 * | 4/2007 | Ishida | F21S 41/323 362/346 |
| 11,041,600 | B2 * | 6/2021 | Sato | F21S 43/249 |
| 2017/0343179 | A1 * | 11/2017 | Gurevich | F21K 9/64 |
| 2020/0041089 | A1 * | 2/2020 | Gromfeld | F21S 41/322 |

FOREIGN PATENT DOCUMENTS

| | | | |
|---|---|---|---|
| JP | 6201708 | B2 | 9/2017 |
| KR | 10-2013-0048540 | A | 5/2013 |
| KR | 10-2019-0080506 | A | 7/2019 |
| KR | 10-2019-0081774 | A | 7/2019 |

* cited by examiner

*Primary Examiner* — Matthew J. Peerce
(74) *Attorney, Agent, or Firm* — Morgan, Lewis & Bockius LLP

(57) ABSTRACT

A slim type lamp apparatus of a vehicle may include a light source for radiating light; and a lens portion including an incident portion through which the light radiated by the light source is incident, a reflection portion extending from the incident portion to reflect and move the incident light, and an emission portion extending from the reflection portion and emitting the light reflected by the reflection portion, the reflection portion diffusing some light upon reflection of the light to form a diffusion beam pattern by the emission portion and condensing other light upon reflection to form a condensing beam pattern by the emission portion.

17 Claims, 7 Drawing Sheets

SLIM TYPE LAMP APPARATUS FOR VEHICLE

CROSS REFERENCE TO RELATED APPLICATION

The present application claims priority to Korean Patent Application No. 10-2020-0172448 filed on Dec. 10, 2020, the entire contents of which is incorporated herein for all purposes by this reference.

BACKGROUND OF THE INVENTION

Field of the Invention

The present invention relates to a slim type lamp apparatus for a vehicle which secures light efficiency and reduces the size of an optical system.

Description of Related Art

A vehicle is provided with a lighting apparatus for the purpose of making it easy to see objects in the traveling direction when traveling at night and for informing other vehicles or other road users of the traveling state of his or her own vehicle. A lamp also called a headlight is a lighting lamp serving to illuminate the path ahead of the vehicle.

Such a lamp is classified into a headlamp, a fog light, a turn signal light, a brake light, and a backup light and the directions in which light is radiated on the road are differently set, respectively, and in the normal traveling situation, the lamp radiates a low beam through the headlamp and radiates a high beam in the special situation.

Meanwhile, an optical system applied to a future vehicle tends to have the reduced entire size, and has the difficulty in reducing the size of the optical system while securing an amount of light.

The information included in this Background of the Invention section is only for enhancement of understanding of the general background of the invention and may not be taken as an acknowledgement or any form of suggestion that this information forms the related art already known to a person skilled in the art.

BRIEF SUMMARY

Various aspects of the present invention are directed to providing a slim type lamp apparatus of a vehicle which has the reduced entire size of the optical system to advantageously configure a package, and secures an amount of light.

A slim type lamp apparatus of a vehicle according to various exemplary embodiments of the present invention for achieving the object includes: a light source for radiating light; and a lens portion including an incident portion through which the light radiated by the light source is incident, a reflection portion extending from the incident portion to reflect and move the incident light, and an emission portion extending from the reflection portion and emitting the light reflected by the reflection portion, the reflection portion diffusing some light upon reflection of the light to form a diffusion beam pattern by the emission portion and condensing the other light upon reflection to form a condensing beam pattern by the emission portion.

Inside widths of the incident portion and the emission portion are greater than an inside width of the reflection portion.

The incident portion includes an incident surface on which the light of the light source is incident, a total reflection surface, which has the inclination such that the width is gradually increased, extending from the incident surface, and a parallel light conversion portion straightly extending from the incident surface in the incident portion.

The parallel light conversion portion includes an incident side surface portion straightly extending from the incident surface so that the incident light is moved to the total reflection surface and an incident center portion curvedly connected to an edge portion of the incident side surface portion so that an incident light is converted into a parallel light to be emitted.

The reflection portion includes a first reflection surface formed to reflect the light incident by the incident portion so that the light is moved toward a focus, a second reflection surface formed to reflect the light reflected by the first reflection surface so that the light is moved toward the emission portion, and a third reflection surface formed to reflect some light reflected by the second reflection surface so that the corresponding light is moved toward the emission portion but moved in a direction different from a path of the light moved by the second reflection surface.

The first reflection surface extends to be curved around the focus, and the second reflection surface is disposed on a movement path of the light reflected by the first reflection surface and moved toward the focus and formed so that the incident light is totally reflected and moved toward the emission portion.

The first reflection surface includes a diffusion reflection surface and a condensing reflection surface around the optical axis of the light source such that the light reflected and moved by the diffusion reflection surface forms the diffusion beam pattern upon reflection by the second reflection surface, and the light reflected and moved by the condensing reflection surface is reflected by the second reflection surface and then reflected by the third reflection surface to form the condensing beam pattern.

The first reflection surface has the diffusion reflection surface disposed behind the condensing reflection surface with respect to a direction in which the light is moved from the incident portion to the emission portion.

The third reflection surface extends from the second reflection surface and extends such that the light reflected by the condensing reflection surface is incident, and is formed so that the light is moved in a direction different from a path of the light through which the incident light is totally reflected and reflected and moved by the diffusion reflection surface.

The third reflection surface has some recessed or protruding regions to form a cut-off portion.

The emission portion includes an upper surface straightly extending from the first reflection surface of the reflection portion, a lower surface, which has at least a portion with the inclination, extending from the third reflection surface, and an emission surface connecting the upper surface to the lower surface.

The slim type lamp apparatus of the vehicle may further include an extra light source for radiating light toward the lower surface of the emission portion.

The extra light source is disposed such that a radiation angle of the light radiated to the lower surface of the emission portion is smaller than an inclination angle of the lower surface.

The slim type lamp apparatus of the vehicle may further include an extra lens portion provided at a position at which the light is emitted by the emission portion to receive the light emitted by the emission portion and for diffusing a light distribution range of the incident light.

The extra lens portion has an incident portion formed to be curved to convert the incident light into parallel light, and a plurality of optics having cross sections, which are formed to protrude from the emission portion.

The extra lens portion is formed so that protrusion thicknesses of the plurality of optics are increased downward.

The lowermost optic among the plurality of optics of the extra lens portion is formed to be inclined forward thereof.

The slim type lamp apparatus of the vehicle having the aforementioned configuration secures the degree of freedom of the vertical width in the region through which the light is emitted, implementing the slim type headlamp. Furthermore, it is possible to secure an amount of light, and to reduce the size of the optical system, advantageously configuring the package.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
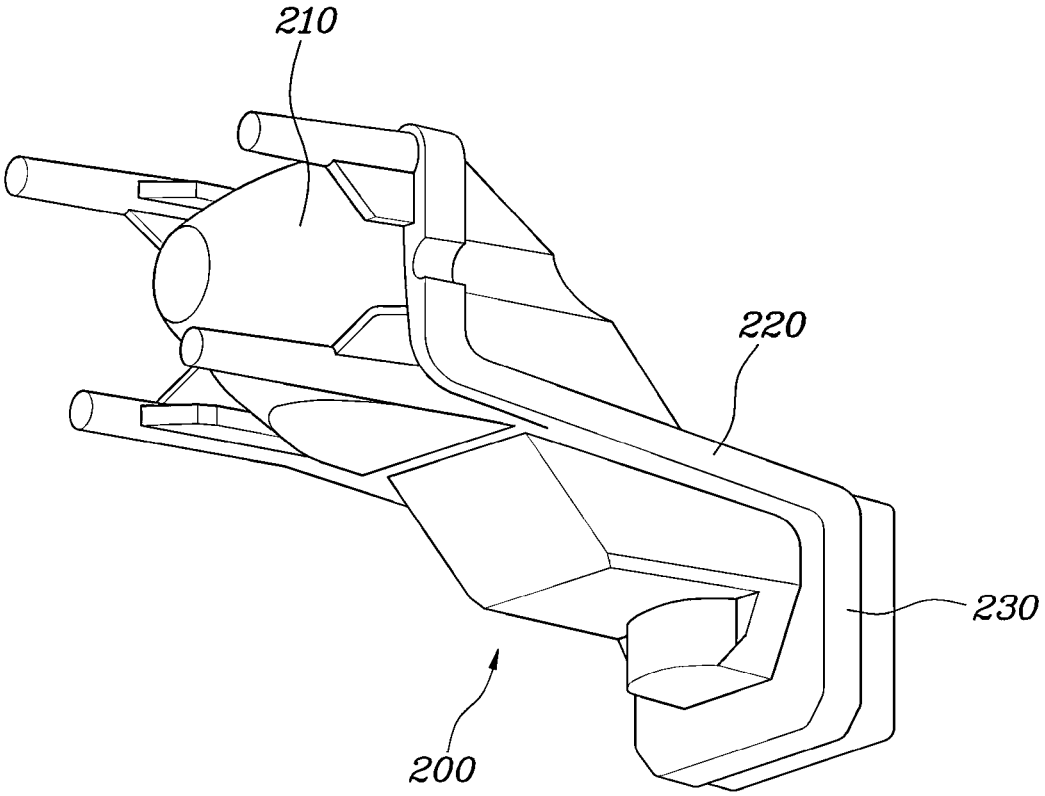
FIG. 1 is a diagram illustrating a slim type lamp apparatus of a vehicle according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION OF THE PRESENT INVENTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

Hereinafter, a slim type lamp apparatus of a vehicle according to various exemplary embodiments of the present invention will be described with reference to the accompanying drawings.

Figure 2:
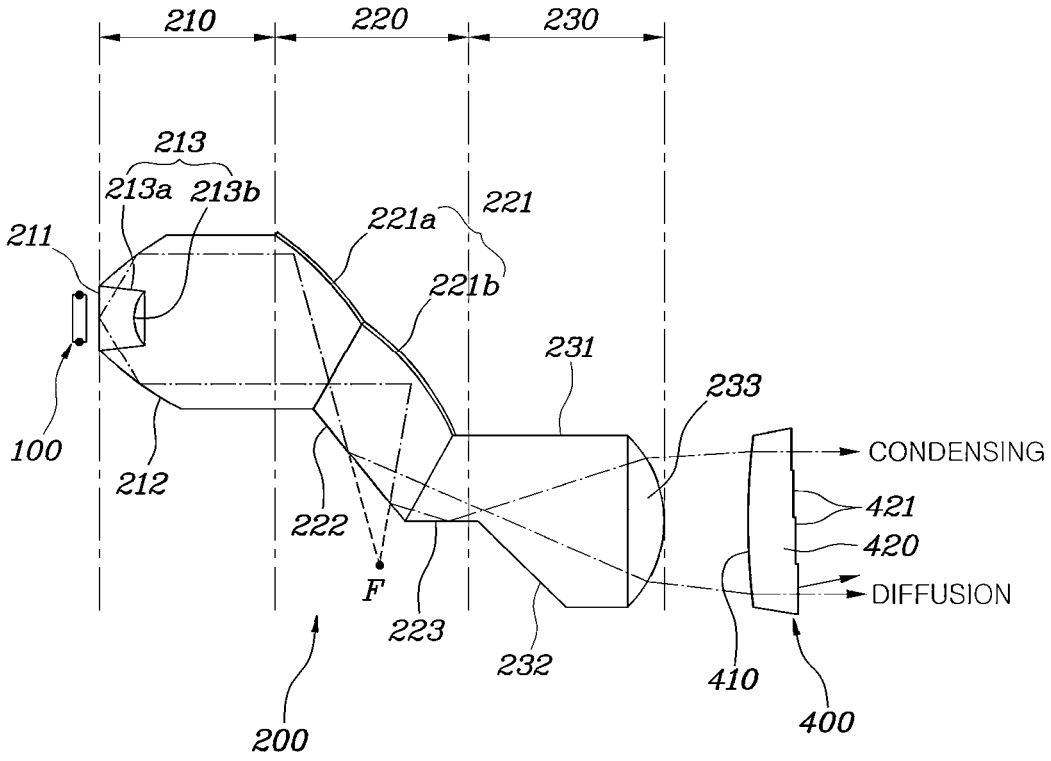
FIG. 2 is a cross-sectional diagram of the slim type lamp apparatus of the vehicle illustrated in FIG. 1.
Figure 3:
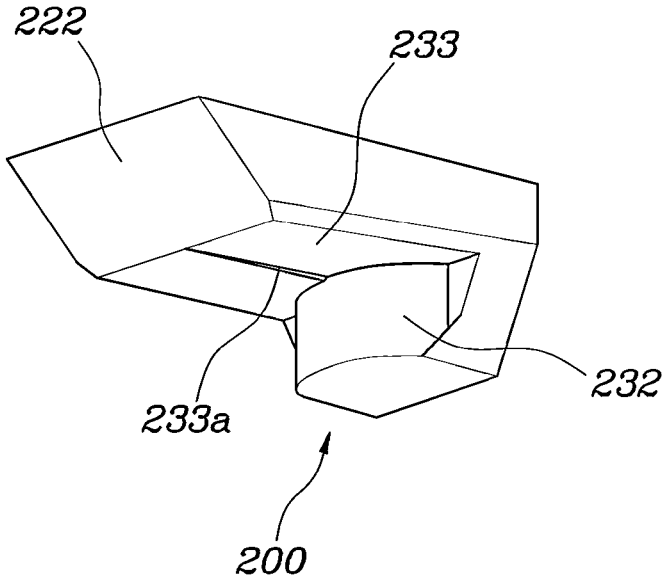
FIG. 3 is a diagram for explaining a cut-off portion of the slim type lamp apparatus of the vehicle illustrated in FIG. 1.
Figure 4:
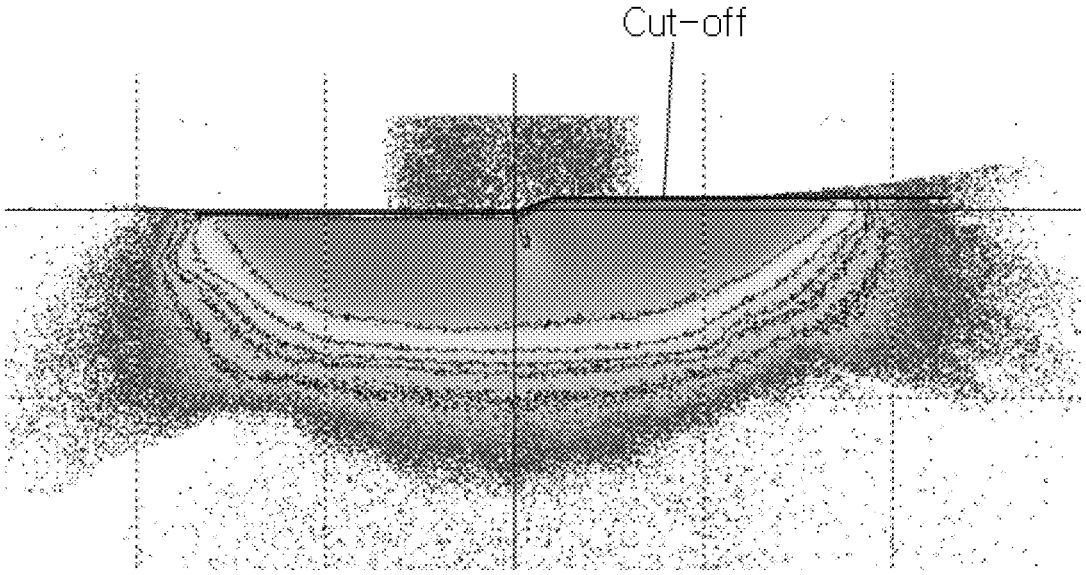
FIG. 4 is a diagram illustrating a diffusion beam pattern formed according to various exemplary embodiments of the present invention.
Figure 5:
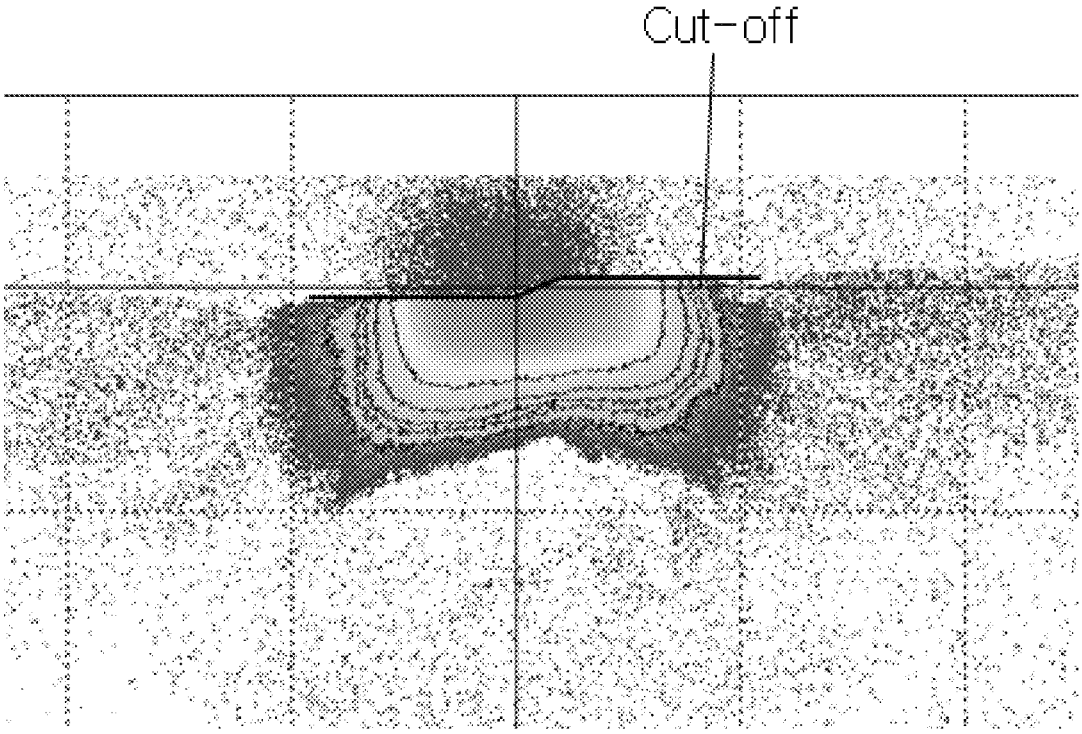
FIG. 5 is a diagram illustrating a condensing beam pattern formed according to various exemplary embodiments of the present invention.
Figure 6:
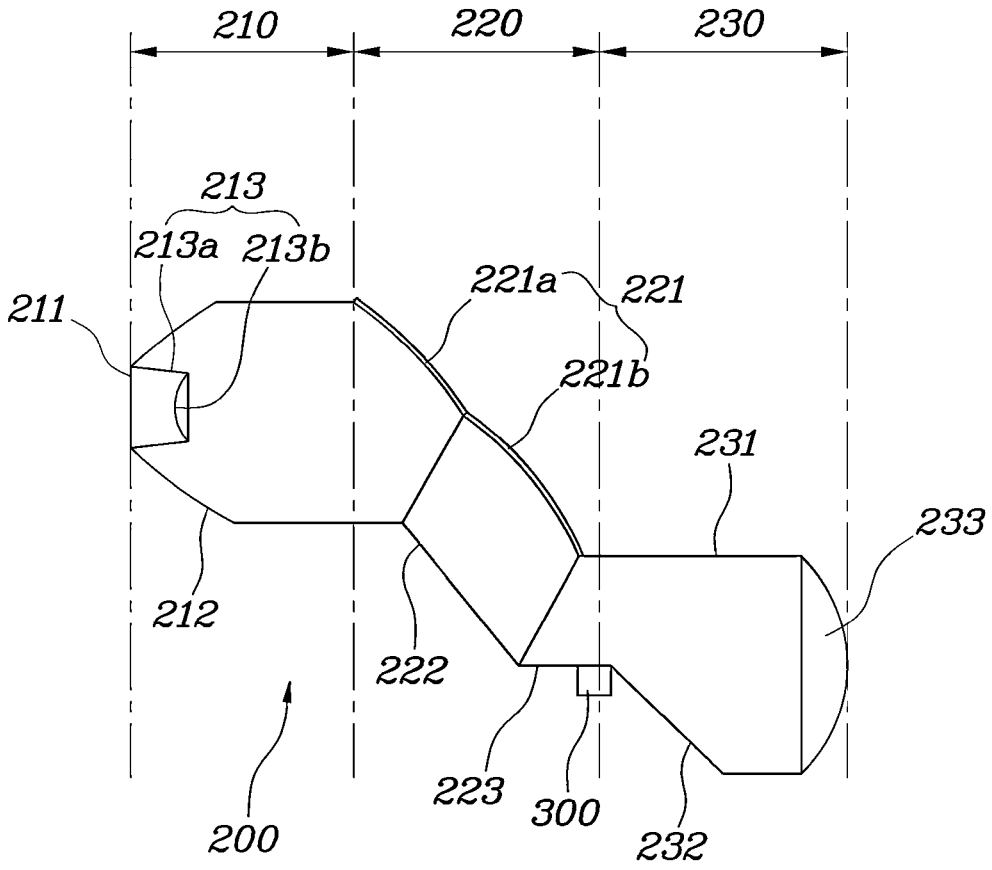
FIG. 6 is a diagram illustrating a slim type lamp apparatus of a vehicle according to various exemplary embodiments of the present invention.
Figure 7:
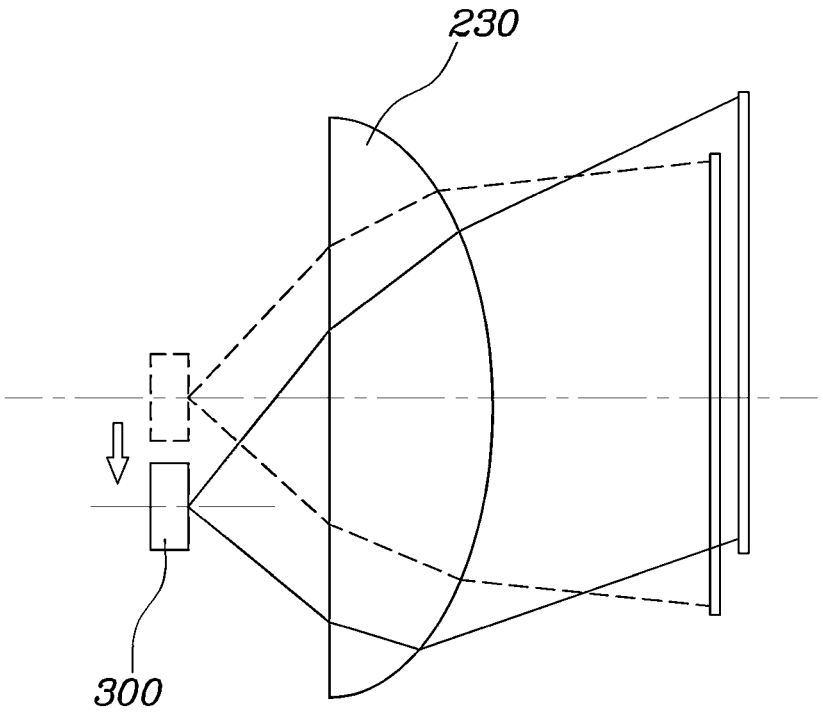
FIG. 7 is a diagram for explaining the light radiation position adjustment according to the position of an extra light source.

FIG. 1 is a diagram illustrating a slim type lamp apparatus of a vehicle according to various exemplary embodiments of the present invention, FIG. 2 is a cross-sectional diagram of the slim type lamp apparatus of the vehicle illustrated in FIG. 1, FIG. 3 is a diagram for explaining a cut-off portion of the slim type lamp apparatus of the vehicle illustrated in FIG. 1, FIG. 4 is a diagram illustrating a diffusion beam pattern formed according to various exemplary embodiments of the present invention, FIG. 5 is a diagram illustrating a condensing beam pattern formed according to various exemplary embodiments of the present invention, FIG. 6 is a diagram illustrating a slim type lamp apparatus of a vehicle according to various exemplary embodiments of the present invention, and FIG. 7 is a diagram for explaining the light radiation position adjustment according to the position of an extra light source.

As illustrated in FIG. 1 and FIG. 2, a slim type lamp apparatus of a vehicle according to various exemplary embodiments of the present invention includes a light source 100 for radiating light; and a lens portion 200 including an incident portion 210 through which the light radiated by the light source 100 is incident, a reflection portion 220 extending from the incident portion 210 to reflect and move the incident light, and an emission portion 230 for emitting the light reflected by the reflection portion 220, in which the reflection portion 220 is formed to diffuse some light upon reflection of the light to form a diffusion beam pattern through the emission portion 230 and to condense the other light upon reflection to form a condensing beam pattern through the emission portion 230.

Here, the light source 100 may be configured as an LED, and the lens portion 200 is disposed on the front of the light source 100.

The lens portion 200 is formed to be curved to reflect the light radiated by the light source 100 to form a specific beam pattern. Therefore, the lens portion 200 includes the incident portion 210 through which light is incident, the reflection portion 220 for reflecting and moving the incident light, and the emission portion 230 for emitting the reflected and formed beam pattern. The reflection portion 220 of the lens portion 200 diffuses some light radiated by the light source 100 to form the diffusion beam pattern through the emission portion 230 and condenses the other light to form the condensing beam pattern through the emission portion 230. As described above, the light radiated by the light source 100 is incident on the lens portion 200 and reflected inside the lens portion 200 to change the movement path the light such that some light is diffused to form the diffusion beam pattern, and the other light is condensed to form the condensing beam pattern. Therefore, the present invention emits the light radiated by the light source 100 through the lens portion 200, securing an among of light for implementing the lighting of the headlamp and reducing the entire size of the optical system.

Specifically describing the aforementioned lens portion 200, the lens portion 200 may be formed to have the inside widths of the incident portion 210 and the emission portion 230 greater than the inside width of the reflection portion 220.

As described above, the reflection portion 220 may be formed to be smaller than the inside width of the incident portion 210 and the inside width of the emission portion 230, reducing the loss of the light reflected and moved by the reflection portion 220. Furthermore, since the lens portion 200 sets only a reflection angle for the movement path of the light when changing the movement path of the light by the reflection portion 220, the reflect portion 220 is formed to reflect the light but formed to have a smaller width, reducing the entire size of the optical system.

Meanwhile, the incident portion 210 may include an incident surface 211 on which the light of the light source 100 is incident, a total reflection surface 212, which has the inclination such that the width is gradually increased, extending from the incident surface 211, and a parallel light conversion portion 213 straightly extending from the incident surface 211.

The incident portion 210 converts the light radiated by the light source 100 into parallel light, in which the light of the light source 100 transmits the incident surface 211 to be incident on the lens portion 200, and the incident light is emitted by the parallel light conversion portion 213.

Here, the parallel light conversion portion 213 includes an incident side surface portion 213*a* straightly extending from the incident surface 211 such that the incident light is moved to the total reflection surface 212 and an incident center portion 213*b* curvedly connected to the edge portion of the incident side surface portion 213*a* such that the incident light is converted into the parallel light to be emitted. As the incident side surface portion 213*a* of the parallel light conversion portion 213 straightly extends, the incident light passes through the incident side surface portion 213*a* and is moved to the total reflection surface 212. Furthermore, the incident center portion 213*b* is curvedly connected to the edge portion of the incident side surface portion 213*a* to form a convex shape such that the incident light is converted into the parallel light. This is based on the design of a total internal reflection (TIR) lens, and the light of the light source 100 incident on the incident portion 210 may be moved by targeting the reflection portion 220.

Meanwhile, the reflection portion 220 may include a first reflection surface 221 formed to reflect the light incident by the incident portion 210 such that the light is moved toward a focus (F), a second reflection surface 222 formed to reflect the light reflected by the first reflection surface 221 such that the light is moved toward the emission portion 230, and a third reflection surface 223 formed to reflect some light reflected by the second reflection surface 222 such that the corresponding light is moved toward the emission portion 230 but moved in the direction different from the path of the light moved by the second reflection surface 222.

That is, the first reflection surface 221 of the reflection portion 220 is a portion through which the parallel light incident by the incident portion 210 is incident and formed to have a curved surface having the focus (F) and curved in a parabolic shape. Therefore, the light incident on the first reflection surface 221 is moved toward the focus (F) upon reflection and incident on the second reflection surface 222. As the second reflection surface 222 is formed to have the inclined surface, the light reflected and moved by the first reflection surface 221 is totally reflected to be moved toward the emission portion 230. The second reflection surface 222 is disposed on the movement path of the light reflected by the first reflection surface 221 and moved toward the focus (F) and formed such that the incident light is totally reflected and moved toward the emission portion 230. The second reflection surface 222 may be formed to have an inclined angle of the condition where the light reflected and moved by the first reflection surface 221 is totally reflected based on the Snell's law. Therefore, the light reflected and moved by the first reflection surface 221 and the second reflection surface 222 is diffused and emitted by the emission portion 230. Furthermore, the reflection portion 220 is formed with a third reflection surface 223 formed to reflect some light reflected by the second reflection surface 222. The third reflection surface 223 reflects the light reflected and moved by the second reflection surface 222 again to change the movement path, and is formed such that the light is emitted to the emission portion 230 in the direction different from that of the light reflected by the second reflection surface 222 and directly emitted toward the emission portion 230. The third reflection surface 223 may be formed in a planar shape, a plurality of planes, or a curved shape such that the light may be condensed, and the light reflected by the third reflection surface 223 is condensed and forms a lighting pattern to be finally emitted.

Describing each reflection surface configuring the reflection portion 220, the first reflection surface 221 may be classified into a diffusion reflection surface 221*a* and a condensing reflection surface 221*b* around the optical axis of the light source 100. Here, the first reflection surface 221 is formed such that the diffusion reflection surface 221*a* is disposed behind the condensing reflection surface 221*b* with respect to the direction in which the light is moved from the incident portion 210 to the emission portion 230. That is, the first reflection surface 221 includes the diffusion reflection surface 221*a* and the condensing reflection surface 221*b*, and all of the diffusion reflection surface 221*a* and the condensing reflection surface 221*b* are formed in the curved surfaces having the same focuses (F). The second reflection surface 222 is disposed on the movement path of the light reflected by the first reflection surface 221 and moved toward the focus (F), and as the third reflection surface 223 extends from the second reflection surface 222, some light is directly emitted by the emission portion 230 upon reflection by the second reflection surface 222, and other light are reflected from the second reflection surface 222 back to the third reflection surface 223 and emitted by the emission portion 230. To distinguish them, the first reflection surface 221 is classified into the diffusion reflection surface 221*a* and the condensing reflection surface 221*b*, the light reflected by the diffusion reflection surface 221*a* is reflected by the second reflection surface 222 and directly emitted by the emission portion 230, and the light reflected by the condensing reflection surface 221*b* is reflected by the second reflection surface 222 and the third reflection surface 223 and emitted by the emission portion 230. The reflection portion 220 may adjust an amount of light of the diffusion beam pattern or light of the condensing beam pattern finally emitted by the emission portion 230 through the setting of the lengths of the diffusion reflection surface 221*a* and the condensing reflection surface 221*b* in the first reflection surface 221, and the length of the third reflection surface 223 to adjust the beam pattern outputted by the headlamp.

As described above, when the parallel light passing through the incident portion 210 is incident on the first reflection surface 221, the light reflected by the diffusion reflection surface 221*a* of the first reflection surface 221 and moved to the second reflection surface 222 is directly moved and emitted toward the emission portion 230 to form the diffusion beam pattern, and the remaining portion of the light reflected by the condensing reflection surface 221*b* of the first reflection surface 221 and moved to the second reflection surface 222 may be again reflected by the third reflection surface 223 and moved toward the emission portion 230 to form the condensing beam pattern.

As described above, the lens portion 200 separates the light reflected and moved by the first reflection surface 221 to separate a lighting image, forming a beam pattern advantageous for the condensing.

Meanwhile, the third reflection surface 223 may extend from the second reflection surface 222 but extends such that the light reflected by the condensing reflection surface 221*b* is incident, and may be formed so that the light is moved in a direction different from a path of the light through which the incident light is totally reflected and reflected and moved by the diffusion reflection surface 221*a*.

The third reflection surface 223 extends from the second reflection surface 222 to reflect some light reflected and moved by the second reflection surface 222. The third reflection surface 223 is formed to extend such that the light is moved in the direction different from the movement path of the light through which the reflected light is reflected and moved by the diffusion reflection surface 221*a* to form the condensing beam pattern. The third reflection surface 223 may straightly extend to be formed in a planar shape, and may also be formed in other shapes for condensing the light. Therefore, as illustrated in FIG. 2, the light radiated by the light source 100 is converted into the parallel light by the incident portion 210, and reflected by the diffusion reflection surface 221*a* and the condensing reflection surface 221*b* of the first reflection surface 221 and moved to the second reflection surface 222. Here, the light reflected and moved by the diffusion reflection surface 221*a* is directly moved toward the emission portion 230 upon reflection by the second reflection surface 222 to form the diffusion beam pattern. Meanwhile, the light reflected and moved by the condensing reflection surface 221*b* is reflected by the second reflection surface 222 and then reflected and moved by the third reflection surface 223 to form the condensing beam pattern.

Furthermore, the third reflection surface 223 may have some recessed or protruding regions to form a cut-off portion 233*a*.

As illustrated in FIG. 3, the third reflection surface 223 is formed with the cut-off portion 233*a*, and formed with a cut-off line for a low beam radiation region by the cut-off portion 233*a*. That is, the light reflected and moved by the first reflection surface 221 and the second reflection surface 222 passes through the third reflection surface 223, and as the third reflection surface 223 is formed with the cut-off portion 233*a*, the intended lighting pattern according to the shape of the cut-off portion 233*a* is formed. The shape of the cut-off portion 233*a* may be determined according to the law.

Therefore, as illustrated in FIG. 4, the light reflected and moved by the diffusion reflection surface among the light radiated by the light source 100 forms the diffusion beam pattern when reflected by the second reflection surface 222 and emitted by the emission portion 230. Meanwhile, as illustrated in FIG. 5, the light reflected and moved by the condensing reflection surface 221*b* among the light radiated by the light source 100 forms the condensing beam pattern when reflected by the second reflection surface 222, then reflected by the third reflection surface 223, and emitted by the emission portion 230.

Meanwhile, the emission portion 230 may include an upper surface 231 straightly extending from the first reflection surface 221 of the reflection portion 220, a lower surface 232, which has the inclination, extending from the third reflection surface 223, and an emission surface 233 connecting the upper surface 231 to the lower surface 232. As described above, the emission portion 230 may be formed to have a gradually increased width by the upper surface 231 straightly extending from the first reflection surface 221 and the lower surface 232, which has at least a portion with the inclination, extending from the third reflection surface 223. Therefore, the beam pattern formed as the light is reflected by the reflection portion 220 may be emitted as the intended beam pattern by the emission surface 233 having the vertically secured space. Here, the emission portion 230 may be formed such that the height of the upper surface 231 and the height of the lower surface 232 are the same as each other on the virtual line of the straight line around the third reflection surface 223.

Meanwhile, as illustrated in FIG. 6, the slim type lamp apparatus of the vehicle may further include an extra light source 300 for radiating light toward the lower surface 232 of the emission portion 230. Here, the extra light source 300 may be configured as an LED, and may radiate the light from the outside of the lens portion 200 to the lower surface 232 of the emission portion 230 to form an extra beam pattern different from the light source 100 for radiating light from the incident portion 210. As an example, the beam pattern by the light source 100 for radiating the light to the incident portion 210 may finally serve as the low beam upon emission, and the beam pattern by the extra light source 300 for radiating the light to the lower surface 232 of the emission portion 230 is configured as a daytime running lights (DRL).

The extra light source 300 may be disposed such that a radiation angle of the light radiated to the lower surface 232 of the emission portion 230 is smaller than the inclination angle of the lower surface 232. Therefore, the lower surface 232 of the emission portion 230 may vertically extend, and the radiation angle of the light of the extra light source 300 is configured to be smaller than the inclination angle of the lower surface 232 of the emission portion 230 such that the light radiated by the extra light source 300 may pass through the lower surface 232 of the emission portion 230 and be moved to the emission surface 233 of the emission portion 230. This is based on the aforementioned Snell's law, and the extra light source 300 has the radiation angle of the light smaller than the reflection angle, which is a critical angle such that the light may transmit the lower surface 232 of the emission portion 230 and be emitted by the emission surface 233. As illustrated in FIG. 7, the extra light source 300 may adjust the vertical position to adjust the formation position of the beam pattern.

Meanwhile, as illustrated in FIG. 2, the slim type lamp apparatus of the vehicle may further include an extra lens portion 400 provided at the position at which the light is emitted by the emission portion 230 to receive the light emitted by the emission portion 230, and for diffusing the light distribution range of the incident light. The extra lens portion 400 receives the light emitted by the emission portion 230 to convert the received light into the parallel light and diffuses the light distribution range to increase the visibility.

The extra lens portion 400 may have an incident portion 410 curvedly formed to convert the incident light into the parallel light, and may have a plurality of optics 421 having the cross sections, which are formed to protrude from the emission portion 420. Therefore, the light emitted and moved by the emission portion 230 is converted into the parallel light by the shape of the incident portion 410 when being incident on the extra lens portion 400 and refracted in the specific direction by the optics 421 of the emission portion 420. As described above, the light emitted by the emission portion 230 is converted into the parallel light by the extra lens portion 400, and the light distribution range is adjusted for the projection position such that the beam pattern is formed in the desired lighting region and the visibility of the beam pattern is also improved.

Here, the extra lens portion 400 may be formed such that the protrusion thicknesses of the plurality of optics 421 are increased downward. That is, the curvature of the light transmitting the extra lens portion 400 is adjusted by the plurality of optics 421, and as the protrusion thickness is increased downward, the movement direction of the light is changed larger. Therefore, the radiation position of the light forming the diffusion beam pattern among the light emitted by the emission portion 230 is adjusted in the direction in which the condensing beam pattern is formed by the emission portion 230, increasing an amount of light.

Furthermore, the lowermost optic 421 among the plurality of optics 421 in the extra lens portion 400 may be formed to be inclined forward thereof. The lowermost optic 421 of the extra lens portion 400 may be less than 13% of the entire area and may implement the signal lighting through the corresponding region. To implement the signal lighting, the extra lens portion 400 may be interlocked with the extra light source 300. As described above, the extra lens portion 400 may adjust the range of the light distribution pattern by the plurality of optics 421 formed on the emission portion 420, and the intended beam pattern may be implemented.

The slim type lamp apparatus of the vehicle including the aforementioned structure secures the degree of freedom of the vertical width of the region through which the light is emitted, implementing the slim type headlamp. Furthermore, it is possible to secure an amount of light and reduce the size of the optical system, advantageously configuring the package.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A lamp apparatus for a vehicle, the lamp apparatus comprising:

a first light source for radiating light; and a first lens portion including:

an incident portion through which the light radiated by the first light source is incident;

a reflection portion extending from the incident portion to reflect and move the incident light; and an emission portion extending from the reflection portion and emitting the light reflected by the reflection portion, wherein the reflection portion diffuses a predetermined amount of light upon reflection of the light to form a diffusion beam pattern by the emission portion and condenses other light upon reflection to form a condensing beam pattern by the emission portion;

wherein the reflection portion includes:

a first reflection surface formed to reflect the light incident by the incident portion so that the light is moved toward a focus;

a second reflection surface formed to reflect the light reflected by the first reflection surface so that the light is moved toward the emission portion; and a third reflection surface formed to reflect a predetermined amount of light reflected by the second reflection surface so that the corresponding light is moved toward the emission portion but moved in a direction different from a path of the light moved by the second reflection surface; and wherein the first reflection surface includes a diffusion reflection surface and a condensing reflection surface around an optical axis of the first light source so that the light reflected and moved by the diffusion reflection surface forms the diffusion beam pattern upon reflection by the second reflection surface, and the light reflected and moved by the condensing reflection surface is reflected by the second reflection surface and then reflected by the third reflection surface to form the condensing beam pattern.

2. The lamp apparatus of claim 1, wherein inside widths of the incident portion and the emission portion are greater than an inside width of the reflection portion.

3. The lamp apparatus of claim 1, wherein the incident portion includes an incident surface on which the light of the first light source is incident, a total reflection surface, which has an inclination so that a width of the total reflection surface is increased, extending from the incident surface, and a parallel light conversion portion straightly extending from the incident surface in the incident portion.

4. The lamp apparatus of claim 2, wherein the parallel light conversion portion includes:

an incident side surface portion straightly extending from the incident surface so that the incident light is moved to the total reflection surface; and an incident center portion curvedly connected to an edge portion of the incident side surface portion so that an incident light is converted into a parallel light to be emitted.

5. The lamp apparatus of claim 1, wherein the first reflection surface extends to be curved around the focus, and wherein the second reflection surface is disposed on a movement path of the light reflected by the first reflection surface and moved toward the focus and formed so that the incident light is totally reflected and moved toward the emission portion.

6. The lamp apparatus of claim 1, wherein the first reflection surface has the diffusion reflection surface disposed behind the condensing reflection surface with respect to a direction in which the light is moved from the incident portion to the emission portion.

7. The lamp apparatus of claim 1, wherein the third reflection surface extends from the second reflection surface but extends so that the light reflected by the condensing reflection surface is incident, and is formed so that the light is moved in a direction different from a path of the light through which the incident light is totally reflected and reflected and moved by the diffusion reflection surface.

8. The lamp apparatus of claim 5, wherein the third reflection surface has at least a recessed or protruding region to form a cut-off portion.

9. The lamp apparatus of claim 5, wherein the emission portion includes an upper surface straightly extending from the first reflection surface of the reflection portion, a lower surface, which has at least a portion with an inclination, extending from the third reflection surface, and an emission surface connecting the upper surface to the lower surface.

10. The lamp apparatus of claim 9, wherein the first reflection surface includes a diffusion reflection surface and a condensing reflection surface around an optical axis of the first light source, and wherein the upper surface of the emission portion straightly extends from the condensing reflection surface of the first reflection surface.

11. The lamp apparatus of claim 9, further including:

a second light source for radiating light toward the lower surface of the emission portion.

12. The lamp apparatus of the vehicle according to claim 11, wherein the second light source is disposed so that a radiation angle of the light of the second light source radiated to the lower surface of the emission portion is smaller than an inclination angle of the lower surface.

13. The lamp apparatus of the vehicle according to claim 11, wherein a distance between an axis of the emission portion and the second light source is adjustable.

14. The lamp apparatus of claim 1, further including:

a second lens portion provided at a position at which the light is emitted by the emission portion to receive the light emitted by the emission portion and for diffusing a light distribution range of an incident light.

15. The lamp apparatus of claim 14, wherein the second lens portion has an incident portion formed to be curved to convert the incident light into parallel light, and a plurality of optics having cross sections, which are formed to protrude from the emission portion.

16. The lamp apparatus of claim 15, wherein the second lens portion is formed so that protrusion thicknesses of the plurality of optics are increased downward.

17. The lamp apparatus of claim 15, wherein a lowermost optic among the plurality of optics of the second lens portion is formed to be inclined forward thereof.

* * * * *